US006935400B1

(12) United States Patent
Welsh

(10) Patent No.: US 6,935,400 B1
(45) Date of Patent: Aug. 30, 2005

(54) PINCH RESISTANT HINGE AND JOINT CONSTRUCTION FOR UPWARD ACTING SECTIONAL DOORS

(75) Inventor: Thomas M. Welsh, Lawrence, KS (US)

(73) Assignee: TMW Group, Inc., Lawrence, KS (US)

( * ) Notice: Subject to any disclaimer, the term of this patent is extended or adjusted under 35 U.S.C. 154(b) by 0 days.

(21) Appl. No.: 10/336,565

(22) Filed: Jan. 3, 2003

Related U.S. Application Data

(63) Continuation-in-part of application No. 09/882,161, filed on Jun. 15, 2001, now Pat. No. 6,527,036.

(51) Int. Cl.[7] ..... E05D 15/16

(52) U.S. Cl. ..... 160/201; 160/229.1; 16/366; 16/370

(58) Field of Search ..... 160/201, 229.1, 160/235, 236; 16/366, 370

(56) References Cited

U.S. PATENT DOCUMENTS

| | | | |
|---|---|---|---|
| 1,078,786 | A | 11/1913 | Hanba et al. |
| 1,659,928 | A | 2/1928 | Townsend |
| 2,071,236 | A | 2/1937 | Pierce |
| 2,263,995 | A | 11/1941 | Katulski |
| 2,300,265 | A | 10/1942 | Siess |
| 2,557,716 | A | 6/1951 | Allee |
| 2,573,181 | A | 10/1951 | Burr |
| 2,688,365 | A | 9/1954 | Garubo |
| 2,694,234 | A | 11/1954 | Roby et al. |
| 2,910,741 | A | 11/1959 | Dettman |
| 3,000,048 | A | 9/1961 | Harsch |
| 3,059,271 | A | 10/1962 | Erickson |
| 3,203,032 | A | 8/1965 | Everett |
| 3,302,690 | A | 2/1967 | Hurd |
| 3,319,697 | A | 5/1967 | Krohn |
| 3,376,913 | A | 4/1968 | Clapsaddle |
| 3,425,766 | A | 2/1969 | Crisera |
| 3,648,755 | A | 3/1972 | Thiele |
| 3,934,635 | A | 1/1976 | Kin |
| 3,941,180 | A | 3/1976 | Thill |
| 4,040,142 | A | 8/1977 | Ippolito |
| 4,095,311 | A | 6/1978 | Janosch |
| 4,470,170 | A | 9/1984 | Gerteis |
| 4,518,026 | A | 5/1985 | Otto et al. |
| 4,667,724 | A | 5/1987 | Dragone |
| 4,873,743 | A | 10/1989 | Toyama |
| 4,878,267 | A | 11/1989 | Roach et al. |
| 4,893,666 | A | 1/1990 | Hörmann |
| 4,972,546 | A | 11/1990 | Lautenschalger, Jr. et al. |
| 4,989,660 | A | 2/1991 | Wagner |
| 5,001,862 | A | 3/1991 | Albenda |

(Continued)

FOREIGN PATENT DOCUMENTS

| | | |
|---|---|---|
| DE | 1116109 | 10/1961 |
| DE | 2853971 | 7/1980 |
| DE | 3922995 | 5/1990 |
| EP | 0337558 | 10/1989 |
| WO | WO 93/09325 | 5/1993 |

*Primary Examiner*—Blair M. Johnson
(74) *Attorney, Agent, or Firm*—Shughert Thomson & Kilroy; Marcia J. Rodgers

(57) ABSTRACT

An upward acting sectional door is has pinch-resistant joints and hinges. The hinges have a top member securable to an upper panel of the door and a base member securable to a lower panel of the door. The base member and top member are connected by first and second links, each of which have a first end pivotally connected to the top member and a second end pivotally connected to the base member. The geometry of the links insures that a foot which depends from the upper panel is always spaced closely enough to the lower panel that a person cannot easily insert a fingertip into the joint. The foot also acts to push a fingertip away from the joint as the door is closed. The hinge may further include a cover which acts to prevent a person from being pinched by the links or hinge members.

36 Claims, 8 Drawing Sheets

U.S. PATENT DOCUMENTS

| | | | | |
|---|---|---|---|---|
| 5,002,114 | A | | 3/1991 | Hörmann |
| 5,016,700 | A | | 5/1991 | Wegner et al. |
| 5,170,832 | A | | 12/1992 | Wagner |
| 5,203,525 | A | | 4/1993 | Remlaoui |
| 5,398,379 | A | | 3/1995 | Kiefer |
| 5,522,446 | A | | 6/1996 | Mullet et al. |
| 5,622,012 | A | | 4/1997 | Schijf |
| 5,634,242 | A | | 6/1997 | Ferrari et al. |
| 5,669,431 | A | | 9/1997 | Druzynski et al. |
| 5,782,283 | A | | 7/1998 | Kendall |
| 5,913,352 | A | | 6/1999 | Scates et al. |
| 5,921,307 | A | | 7/1999 | Ford et al. |
| 6,006,817 | A | | 12/1999 | Stone et al. |
| 6,076,590 | A | | 6/2000 | Ford et al. |
| 6,098,697 | A | | 8/2000 | Krupke et al. |
| 6,175,991 | B1 | | 1/2001 | Driesman et al. |
| 6,527,036 | B1 | * | 3/2003 | Welsh ..... 160/201 |

* cited by examiner

PINCH RESISTANT HINGE AND JOINT CONSTRUCTION FOR UPWARD ACTING SECTIONAL DOORS

This application is a continuation-in-part of application Ser. No. 09/882,161 filed Jun. 15, 2001, now U.S. Pat. No. 6,527,036.

BACKGROUND OF THE INVENTION

1. Field of the Invention

This invention relates to the field of upward acting sectional doors such as those used on garages and the like, and more particularly to an improved hinge for use on such doors which prevents a person from pinching his or her fingers between door sections when closing the door.

2. Description of the Related Art

Upward acting sectional doors are commonly used on garages, airplane hangars, warehouses, and other buildings where relatively large door openings must be selectively opened and closed. The doors are generally comprised of a plurality of horizontal sections joined together by hinges. Each door section is carried by rollers positioned at opposite ends thereof which engage respective roller tracks attached to the building on opposite sides of the door opening. Each door track includes a vertical portion proximate the door opening and a generally horizontal portion located above the door opening and perpendicular to the wall in which the door opening is formed. The vertical and horizontal portions of the door tracks are joined by arcuately curved portions.

The door rolls along the roller tracks between a closed position wherein the door covers the door opening and a raised position wherein the door is positioned on the horizontal portions of the roller tracks above the door opening in generally parallel relation to the floor. In order to move between the open and closed positions, the door must traverse the arcuate portion of the door tracks, and therefore it is required that the door be able to bend along the joints between the sections.

Upward acting sectional doors are provided with either torsional or extension springs which bias the door into the raised position in order to make them easier to open. A handle is generally provided proximate the bottom of the door for a user to grasp in order to raise and lower the door.

A common problem with upward acting sectional doors is that conventional hinges generally have their pivot pins spaced outwardly from the interior surface of the door such that fairly large gaps are created at the outside of the door along the joint when the door is opened. These gaps fold together when the door is pulled closed. Many users tend to grasp the door by the edges of the door sections instead of using the handle when pulling the door closed. Operating the door in this manner can cause the user's fingers or hands to be pinched between the door sections as they come together during closing. Inattentive bystanders are also subject to getting body parts caught in the joints as the doors close. Serious and painful injuries can result from these pinching accidents.

Most previous attempts so solve this problem have involved moving the pivot pin of the door hinge to a point located between the interior and exterior planes of the door and providing the door sections with mating arcuate top and bottom surfaces. This design allows the top and bottom surfaces of the door sections to rotate in close relation to one another so that no gap large enough to get a finger into is created when the door is opened. Doors of this general type are disclosed by U.S. Pat. Nos. 5,002,114; 5,782,283; 5,913,352; 5,921,307; 6,076,590; and 6,098,697.

Some of these designs, such as those disclosed by U.S. Pat. Nos. 5,002,114 and 6,098,697 require the use of door panels with elaborate mating surfaces which are expensive and difficult to construct. Other designs, such as those disclosed by U.S. Pat. Nos. 5,782,283; 5,913,352; and 5,921,307 are only well suited for use with noninsulated, single skin, metal doors where access to the interior of the door is not an issue. To adapt the designs shown by this second group of patents for use with a hollow core, solid core, or insulated door, pockets such as those shown in U.S. Pat. No. 6,076,590 would have to be provided. These pockets are undesirable because they weaken the door and decrease its insulating value.

What is needed is a garage door having simple and efficient pinch resistant hinges which do not have a pivot pin that must be installed between the interior and exterior planes of the door.

SUMMARY OF THE INVENTION

The present invention comprises an upward acting sectional door wherein the lower edge of each door panel (with the exception of the lowermost panel) includes an elongated foot which extends downwardly from the lower edge proximate the outer surface of the door panel. The lower edge slopes upwardly from the foot toward the inner surface of the door panel. The lower edge further includes an elastomeric door seal for engaging the upper edge of the adjacent panel when the door is in the closed position and sealing the joint. The upper edge of each panel (with the exception of the uppermost panel) includes a ledge proximate the outer surface of the door panel for engaging the foot of the adjacent panel when the door is in the closed position. The upper edge slopes upwardly from the ledge toward the inner surface of the door panel.

Adjacent door panels are connected to one another by a plurality of hinges. Each hinge comprises a top member fastened to the inner surface of the upper door panel and a base member fastened to the inner surface of the lower door panel. The top member is connected to the base member by a short link and a long link; each of the links having a first end pivotally connected to the top member and a second end pivotally secured to the base member. The hinges are enclosed so that a user cannot easily be pinched by the internal components of the hinges.

The geometry of the hinge links insures that the foot of each door panel is always spaced less than nine millimeters from said upper edge of the adjacent panel, even when the door is in the fully open position. This close spacing between the panels does not provide sufficient clearance for a person to interpose a fingertip into the joint where it can be pinched. The foot also acts to push a fingertip positioned proximate the respective joint away from said joint as said door moves from the open position to the closed position.

The geometry of the hinges also acts to aid in the sealing of the joints between the panels. The door seal of each panel moves so as to engage the upper edge of the adjacent panel when the door is in the closed position, but lifts away from the upper edge as the door moves from the closed position toward the open position. This movement of the door seal relative to the adjacent panel prevents the seal from dragging against the adjacent panel and wearing prematurely.

DETAILED DESCRIPTION OF THE PREFERRED EMBODIMENT

Figure 1:
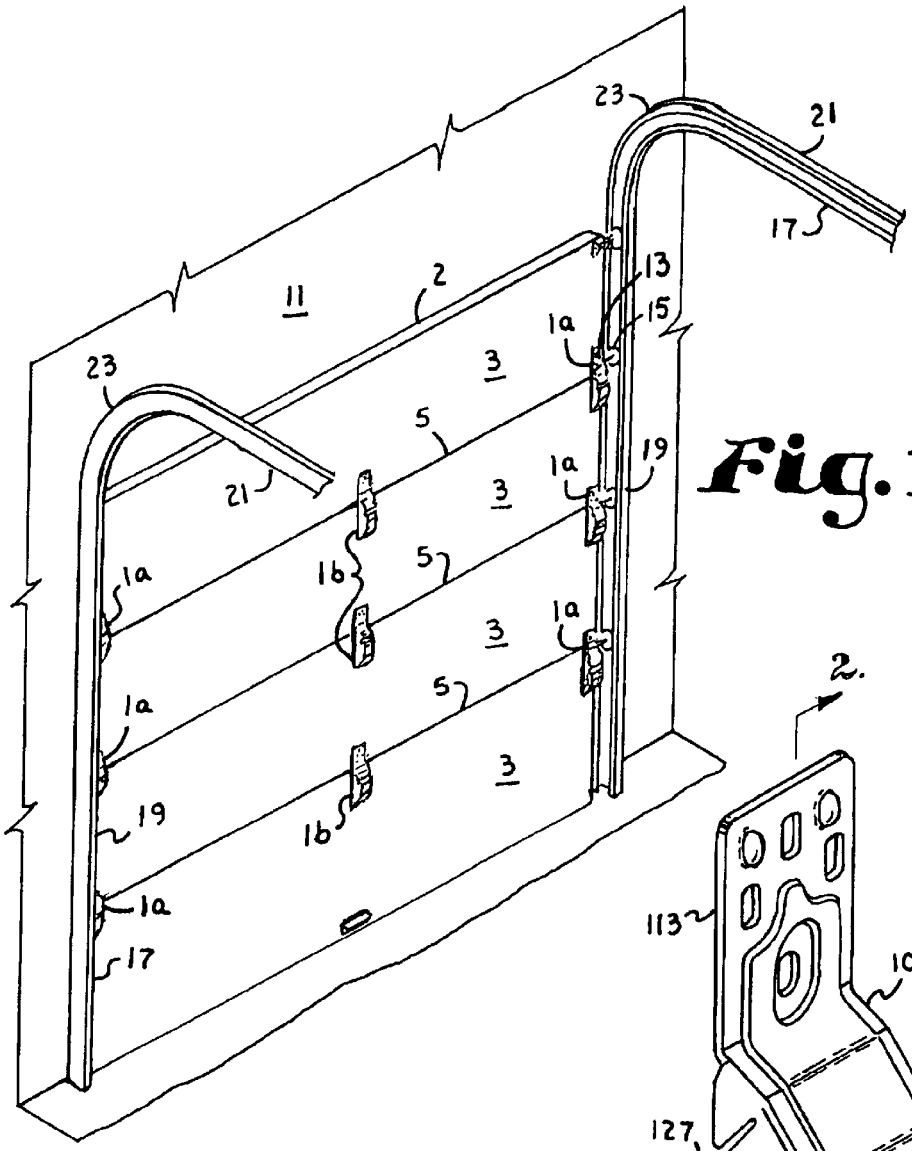
FIG. 1 is a perspective view of the inside of an upward acting sectional door including the pinch resistant hinge and joint construction of the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 1A:
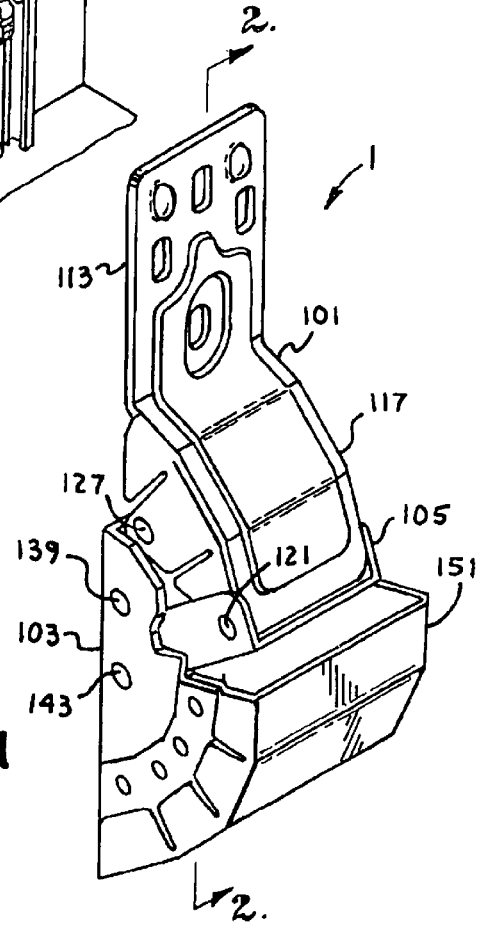
FIG. 1*a* is an enlarged perspective view of one of the hinges of FIG. 1.

Referring to the drawings in more detail, and in particular to FIGS. 1 and 1*a,* the reference number 1 generally designates an upward acting sectional door hinge for use on a door 2 comprised of a plurality of horizontal panels 3 which abut one another along respective joints 5 and are pivotally connected to one another by the hinges 1. The door 2 is adapted to selectively cover a door opening (not shown) in a wall 11. Each joint 5 is equipped with at least two hinges I including a pair of end hinges 1*a,* which are located proximate the ends of the panels 3. Depending on the length of the door 1, the joints 5 may also include one or more intermediate hinges 1*b* spaced along the joint 5 between the end hinges 1*a*. Each of the end hinges 1*a* includes a roller carrier 13 which carries a roller 15. The rollers 15 rollingly engage a pair of standard roller tracks 17 having a vertical portion 19 mounted to the wall 11 proximate the ends of the door opening and a horizontal portion 21 which extends outwardly from the wall 11 above the door opening. The vertical portion 19 and horizontal portion 21 of each track 17 are connected by a curved portion 23.

The door 2 will be described and depicted herein as being either a non-insulated metal door 2*a* (see FIGS. 2–4), or an insulated door 2*b* (see FIG. 5) having metal inner and outer skins with a layer of insulating material 24 sandwiched therebetween. It is to be understood, however, that the hinge 1 of the present invention may be used with doors 2 constructed of any of the variety of other materials commonly used in the manufacture of upward acting sectional doors, including wood, aluminum, fiberglass, and composite materials. It is to be further understood that the hinge 1 may be used with doors 2 incorporating various joint designs.

Non-Insulated Door

Figure 2:
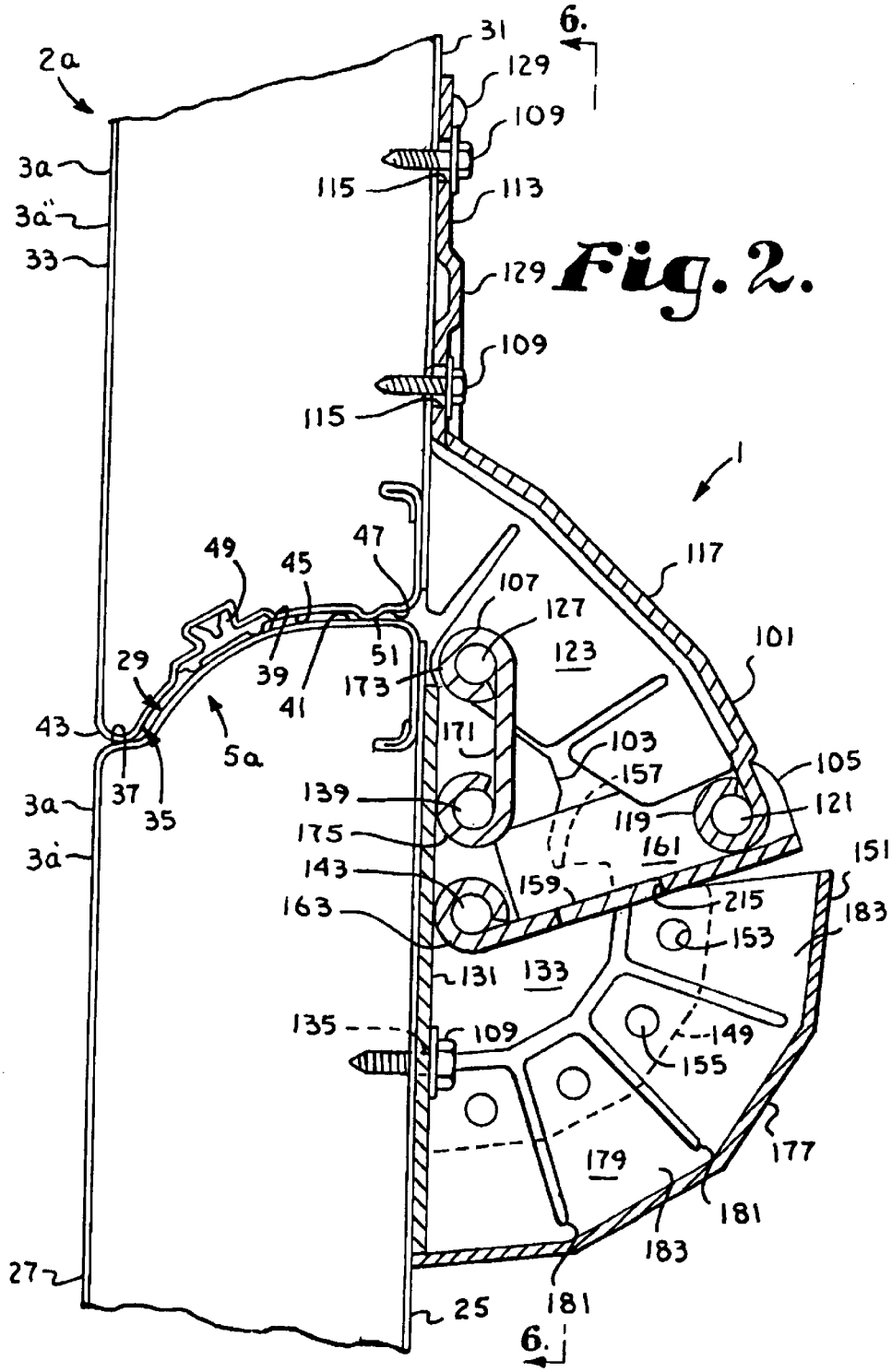
FIG. 2 is a cross-sectional view of one of the hinges of the present invention in a closed position taken generally along line 2—2 in FIG. 1 a and a portion of a non-insulated door including one of the joints thereof.

Referring to FIG. 2, the non-insulated door 2*a* is comprised of a plurality of horizontal panels 3*a* which abut one another along respective joints 5*a* and are pivotally connected to one another by the hinges 1. Since each of the joints 5*a* are identical, only one of the joints 5*a* will be described in detail herein. Each joint 5*a* lies between a pair of the door panels 3*a* such that the panel 3*a* located directly below a respective joint 5*a* may be designated as a lower panel 3*a*' and the panel 3*a* directly above the joint 5*a* may be designated as an upper panel 3*a*" relative to the respective joint 5*a*. The lower panel 3*a*' has an inner surface 25, an outer surface 27, an upper edge 29 and a lower edge (not shown). Similarly, the upper panel 3*a*" has an inner surface 31, an outer surface 33, a lower edge 35, and an upper edge (not shown). The door panels 3*a* may be hollow core panels in which the inner surfaces 25 and 31 continue along the entire length of the respective panels 3*a,* or the panels 3*a* may be of a stile-and-rail construction which is generally open on the interior side. In the case of stile-and-rail type non-insulated panel 3*a,* the inner surfaces 25 and 31 are the interior portions of stiles positioned at the ends of the respective panels 3*a* and at intermediate positions therebetween.

The upper edge 29 of the lower panel 3*a*' has an outer ledge 37 which is proximate the outer surface 27, and generally perpendicular thereto. From the outer ledge 37, the upper edge 29 of the lower panel 3*a*' curves upwardly through a convexly arced portion 39 to an inner portion 41 which is proximate the inner surface 25 and generally perpendicular thereto.

The lower edge 35 of the upper panel 3*a*" is shaped to mate with the upper edge 29 of the lower panel 3*a*' when the door 2*a* is in the closed position. The lower edge 35 includes an outer foot 43 proximate the outer surface 33 which is sized to engage the outer ledge 37 of the lower panel 3*a*'. From the outer foot 43, the lower edge 35 curves upwardly through a concavely arced portion 45 to an inner portion 47 which is proximate the inner surface 31 and generally perpendicular thereto. An elastomeric joint seal 49 is set into the concave portion 45 of the upper panel 3*a*" for engaging the convex portion 39 of the lower panel 3*a*' and thereby sealing the joint 5*a* against drafts and water leakage. A bead or inner foot 51 extends downwardly from the inner portion 47 of the upper panel 3*a*" which is adapted to abut the inner portion 41 of the lower panel 3*a*' in the closed position to provide the proper spacing for the seal 49.

Insulated Door

Figure 5:
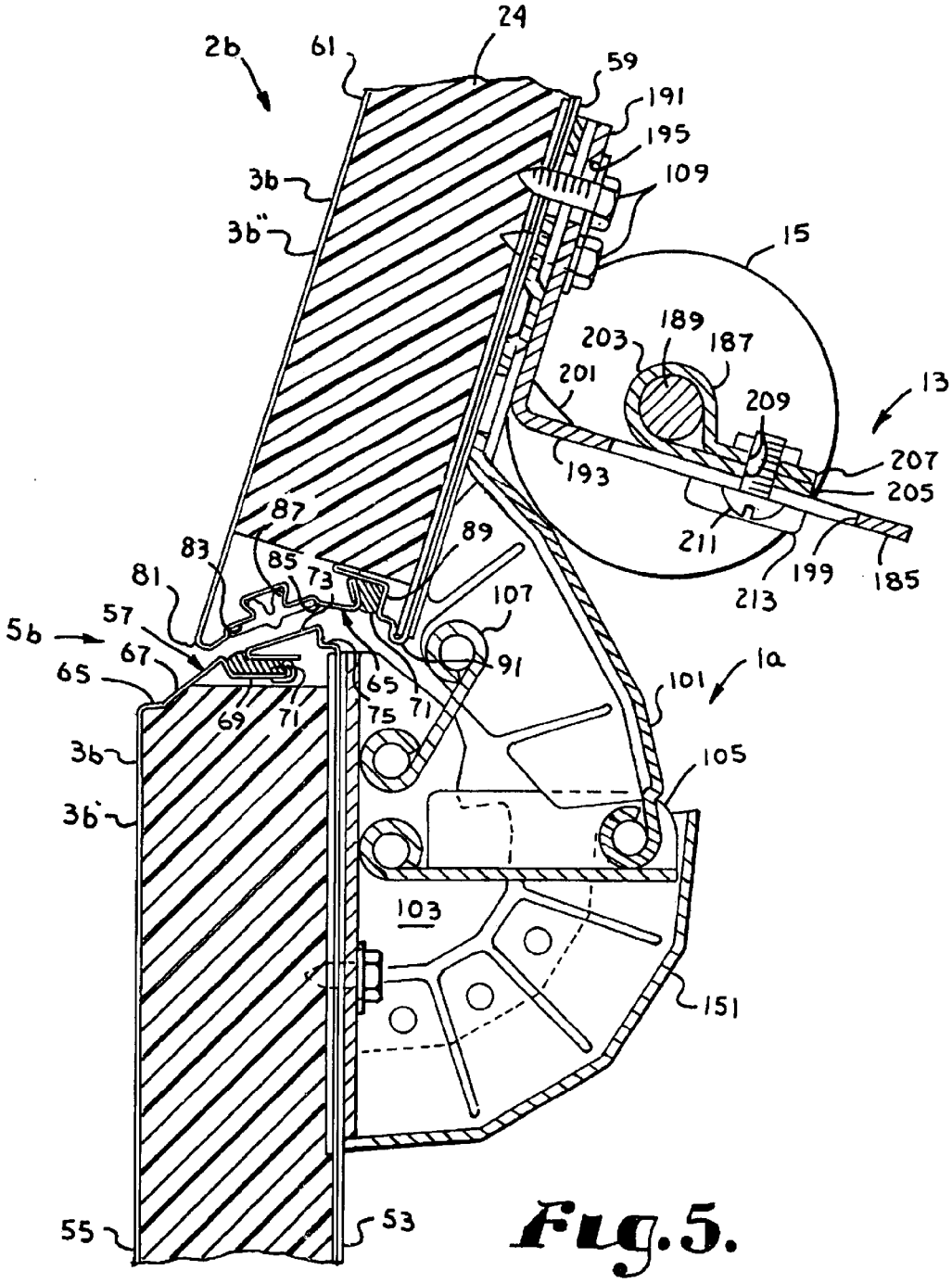
FIG. 5 is a cross-sectional view of one of the hinges of the present invention in a partially open position and including a door roller and roller carrier and a portion of an insulated door including one of the joints thereof.

Referring to FIG. 5, the insulated door 2*b* is comprised of a plurality of horizontal panels 3*b* which abut one another along respective joints 5*b* and are pivotally connected to one another by the hinges 1. Since each of the joints 5*b* are identical, only one of the joints 5*b* will be described in detail herein. Each joint 5*b* lies between a pair of the door panels 3*b* such that the panel 3*b* located directly below the joint 5*b* may be designated as a lower panel 3*b*' and the panel 3*b* directly above the joint 5*b* may be designated as an upper panel 3*b*" relative to the particular joint 5*b*. The lower panel 3*b*' has an inner surface 53, a outer surface 55, an upper edge 57 and a lower edge (not shown). Similarly, the upper panel 3*b*" has an inner surface 59, an outer surface 61, a lower edge 63, and an upper edge (not shown).

The upper edge 57 of the lower panel 3*b*' has an outer ledge 65 which is proximate the outer surface 61 and generally perpendicular thereto. From the outer ledge 65, the upper edge 57 of the lower panel 3*b*' slopes upwardly through a first inclined portion 67 to a thermal break 69 which is filled with a silicone material 71 to decrease the conduction of heat through the upper edge 57. From the thermal break 69, the upper edge 57 again slopes upwardly through a second inclined portion 73. At the top of the second inclined portion 73, the upper edge 57 steps downwardly to an inner notch or rabbet 75 which is proximate the inner surface 59 and generally perpendicular thereto.

The lower edge 63 of the upper panel 3*b*" is shaped to mate with the upper edge 57 of the lower panel 3*b*' when the door 2*b* is in the closed position. The lower edge 63 includes an outer foot 81 proximate the outer surface 61 which is sized to engage the outer ledge 65 of the lower panel 3*b*'. From the outer foot 81, the lower edge 63 angles upwardly through an inclined portion 83 to an inner portion 85. An elastomeric joint seal 87 is set into the inclined portion 83 of the upper panel 3*b*" for engaging the first inclined portion 67 of the lower panel 3*b*' and thereby sealing the joint 5*b* against drafts and water leakage. The inner portion 85 includes a thermal break 89 which, like the thermal break 69 is filled with silicone material 71 and decreases the conduction of heat through the lower edge 63. The lower edge 63 further includes an inner foot 91 which depends downwardly from the inner portion 85 proximate the inner surface 59. The inner foot 91 is sized and shaped to engage the rabbet 75 of the lower panel 3*b*' when the door 2*b* is in the closed position.

Hinge

As best seen in FIG. 2, each hinge 1 includes a top member 101 which is fastened to the upper door panel 3*a*" or 3*b*" and a base member 103 which is fastened to the lower door panel 3*a*' or 3*b*'. The top member 101 is pivotally connected to the base member 103 through two links; a first or long link 105 and a second or short link 107. The top member 101, base member 103, long link 105, and short link 107 are preferably stamped out of heavy sheet steel, such as 0.080 inch thick, galvanized cold-rolled steel. The top member 101 and base member 103 may be fastened to the respective door panels 3 using screws or bolts 109 of a size and type appropriate for the construction of the door panels 3. Self-tapping bolts 109 are shown engaging the respective door panels 3.

Figure 6:
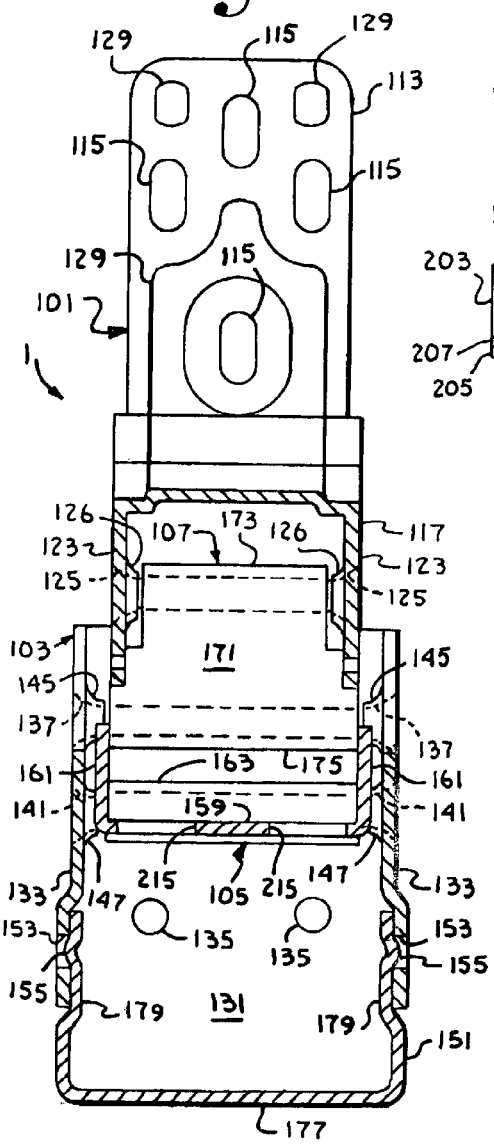
FIG. 6 is a cross-sectional view of one of the hinges of the present invention taken generally along line 6—6 in FIG. 2.

The top member 101 of each hinge 1 includes a mounting flange 113 having a plurality of mounting holes 115 (four shown in FIG. 6) for receiving the bolts 109. The top three mounting holes 115 are preferably used when mounting an end hinge 1*a;* the center two holes 115 are used when mounting an intermediate hinge 1*b*. The holes 115 are preferably elongated to allow adjustment of the positioning of the top member 101 relative to the upper panel 3*a*" or 3*b*". A cantilever 117 is connected to the lower end of the mounting flange 113 and extends outwardly and downwardly therefrom. The distal end of the cantilever 117 is rolled into a sleeve 119 for receiving a first hinge pin 121. The cantilever 117 further includes a pair of side flanges 123 which extend downwardly from the cantilever 117 along opposed side edges thereof. The side flanges 123 include aligned holes or receivers 125 for receiving a second hinge pin 127. In forming the receivers 125, the metal around the receivers 125 is extruded inwardly to form spacers 126. The mounting flange 113 and cantilever 117 may also include raised portions 129 which provide rigidity for the top member 101.

The base member 103 is of a generally C-shaped cross section and includes a mounting plate 131 and a pair of side flanges 133 which extend outwardly from the mounting plate 131 along opposing side edges thereof. The mounting plate 131 includes a plurality of mounting holes 135 (two shown) for receiving a corresponding number of the mounting bolts 109 for attaching the base member 103 to the lower door panel 3*a*' or 3*b*'. The side flanges 133 include an aligned pair of upper receivers 137 for accepting a third hinge pin 139, and an aligned pair of lower receivers 141 for receiving a fourth hinge pin 143. The metal around the upper receivers 137 and lower receivers 141 is extruded inwardly to form spacers 145 and 147 respectively. The upper receivers 137 and lower receivers 141 are spaced outwardly from the mounting plate 131 the same distance as the receivers 125 in the top member 101 are spaced outwardly from the mounting flange 113. Therefore, the receivers 125, 137, and 141 all lie along a plane spaced outwardly from and generally parallel to the inner surfaces 31 and 25 of the door panels 3 when the door 2 is in the closed position.

The side flanges 133 each include an outer edge 149 which is formed in a succession of segments, each segment having a greater pitch angle than its successor, such that the outer edges 149 are of a multi-sided shape approximating a quarter circle. Proximate the outer edges 149, the side flanges 133 are offset outwardly to receive a hinge cover 151 (to be described later) which snaps into place between the side flanges 133. A plurality of holes 153 are provided in the side flanges 133 to receive corresponding protrusions or buttons 155 on the hinge cover 151 which hold the hinge cover 151 in place. The upper edges of the side flanges 133 include a notch 157 which provides clearance for the upper door panel 3*a*" or 3*b*" as the door 2 is opened.

The long link 105 comprises a plate 159 having side flanges 161 formed along opposed sides thereof. One end of the plate 159 is rolled to form a sleeve 163. The side flanges 161 have aligned receivers 165 formed therein proximate the end of the link 105 opposite the sleeve 163. The metal around the receivers 165 is extruded inwardly to form spacers 167. The side flanges 161 are spaced apart such that the top member sleeve 119 will fit transversely between the spacers 167 associated with the receivers 165. The long link 105 is pivotally connected to the top member 101 by the first hinge pin 121 which is inserted through the receivers 165 and the top member sleeve 119. The long link 105 is pivotally connected to the base member 103 by the fourth hinge pin 143 which is inserted through the base member lower receivers 141 and the link sleeve 163. The ends of the hinge pins 121 and 143 are then peened to retain the long link 105 in position.

The short link 107 generally comprises a plate 171 which is rolled at each end to form respective first and second sleeves 173 and 175. The first sleeve 173 is of a length sized to fit between the spacers 126 associated with the receivers 125 of the top member 101, and the second sleeve 175 is sized to fit between the spacers 145 associated with the upper receivers 137 of the base member 103. The short link 107 is pivotally connected to the top member 101 by the second hinge pin 127, which is inserted through the first sleeve 173 and the top member receivers 125. The short link 107 is pivotally connected to the base member 103 by the third hinge pin 139, which is inserted through the second sleeve 175 and the base member upper receivers 137. The ends of the hinge pins 127 and 139 are then peened to retain the short link 107 in position.

The hinge cover 151 may be stamped out of sheet steel of the same type as used to form the other parts of the hinge 1, or may be made of a high impact plastic material. The hinge cover 151 includes an outer guard panel 177 and a pair of opposed side panels 179. The guard panel 177 repeats the multi-sided shape of the outer edge 149 of the base member side flanges 133 and is of a width generally equal to that of the base member 103. The side panels 179 are offset inwardly such that they fit snugly between the outwardly offset portions of the base member side flanges 133. Each of the side panels 179 contains a number of radial slits 181 such that the panel 179 is divided into a number of fingers 183 which may flex relative to the guard panel 177. Each of the fingers 183 includes one of the buttons 155 which projects outwardly therefrom. The hinge cover 151 snaps in place over the lower portion of the base member 103 with the buttons 155 engaging the side flange holes 153. When the hinge cover 151 is installed, the guard panel 177 is spaced outwardly from the base member 103 a sufficient distance for the long link 105 and cantilever 117 of the top member 101 to rotate inside the hinge cover 151. The hinge cover 151 thereby serves to prevent a user from getting his or her fingers pinched between the long link 105 and the base member mounting plate 131 as the door 2 is operated.

Roller Carriers

Figure 7:
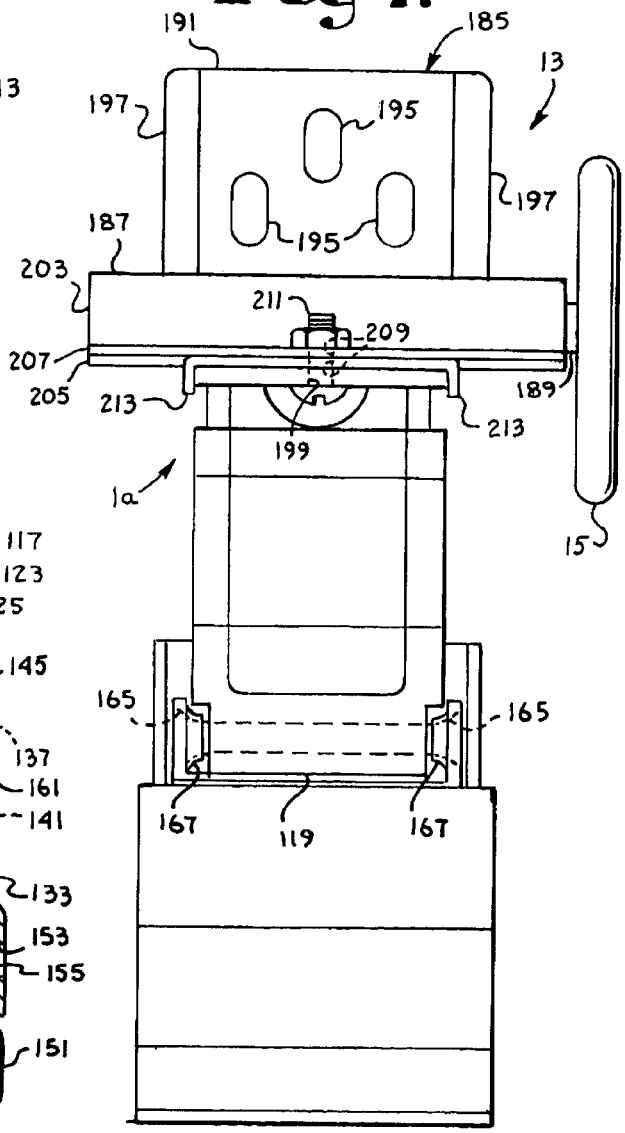
FIG. 7 is a front view of one of the hinges of the present invention and including a door roller and roller carrier.

As best seen in FIGS. 5 and 7, each of the end hinges 1 a further includes a roller carrier 13 for carrying one of the door rollers 15. The roller carrier 13 includes a generally L-shaped mounting bracket 185 and an axle clamp 187 through which an axle 189 of the roller 15 is inserted. The mounting bracket 185 includes a first leg 191 sized and shaped to abut the top member mounting flange 113 of the respective hinge 1*a,* and a second leg 193 which extends outwardly therefrom. The first leg 191 includes a plurality of mounting holes or slots 195 which are equally sized and spaced with the top three mounting holes 115 in the top member mounting flange 113. The carrier mounting bracket 185 is held in position relative to the hinge 1*a* by the mounting bolts 109 which pass through both the mounting holes 195 in the bracket 185 and the corresponding mounting holes 115 in the top member mounting flange 113. The first leg 191 also includes a pair of elongate feet 197 which engage the inner surface 31 or 59 of the respective upper door panel 3*a*" or 3*b*" on opposite sides of the top member mounting flange 113. The second leg 193 of the bracket 185 includes a longitudinal center slot 199. Gussets 201 are formed at the intersection of the first leg 191 and the second leg 193 for strength.

The axle clamp 187 comprises an elongated, tubular axle receiver 203 having a lower clamp flange 205 extending outwardly from a bottom portion thereof and an upper clamp flange 207 extending outwardly from a top portion thereof. Aligned holes 209 are formed in the first and second clamp flanges 205 and 207. The axle clamp 187 is attached to the second leg 193 of the mounting bracket 185 by a bolt 211 which is inserted through the holes 209 and the center slot 199. A pair of ears 213 extend downwardly from the lower clamp flange 205 on opposite sides of the bracket second leg 193 to keep the axle clamp 187 aligned transversely with the bracket second leg 193. The axle clamp 187 may be moved longitudinally along the slot 199 to adjust the spacing between the door 2 and the wall 11. Tightening down the bolt 211 locks the axle clamp 187 into position relative to the bracket 185.

Operation

Figure 3:
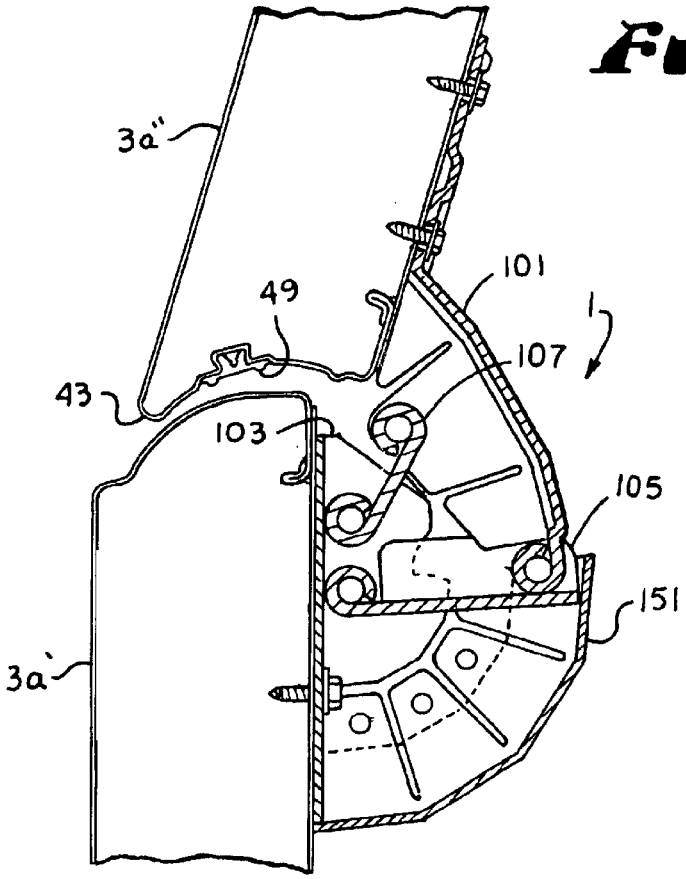
FIG. 3 is a cross-sectional view the hinge and joint of FIG. 2 in a partially open position.
Figure 4:
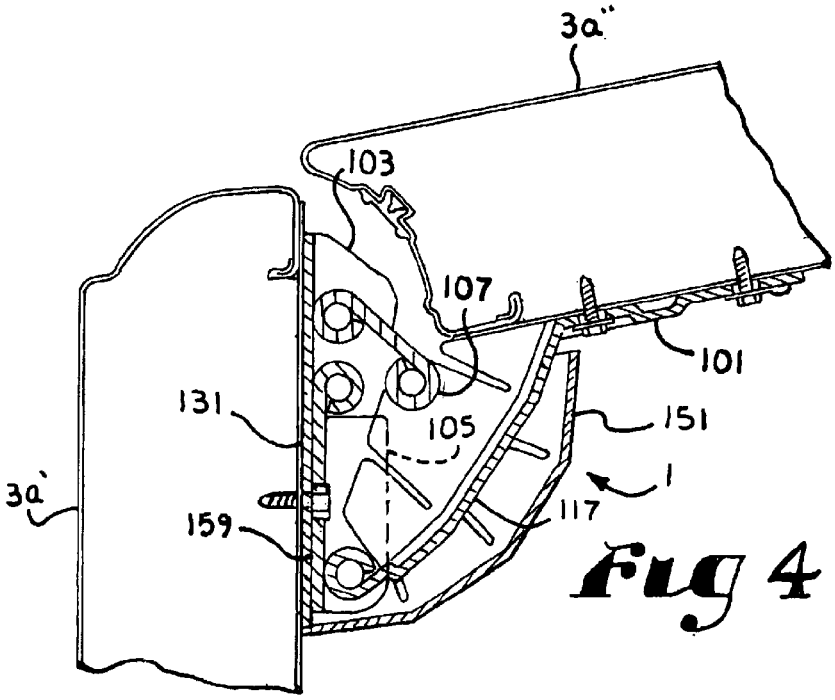
FIG. 4 is a cross-sectional view the hinge and joint of FIG. 2 in the fully open position.

In use, the hinges 1 operate in conjunction with the design of the joints 5 to make the door 2 pinch resistant. The range of motion of a hinge 1 secured to the non-insulated door 2*a* is shown in FIGS. 2–4. As the door 2*a* is raised and lowered, the hinges 1 and their respective joints 5*a* move from a closed position shown in FIG. 2, wherein the upper panel 3*a*" is vertically aligned with the lower panel 3*a*' through a partially opened position shown in FIG. 3; to a fully open position shown in FIG. 4 wherein the upper panel 3*a*" is at an approximately 260 degree angle relative to the lower panel 3*a*'. The hinge 1 cannot move past the fully open position because the long link plate 159 abuts against the base member mounting plate 131 in this position and thereby prevents further movement. The link plate 159 includes a pair of clearance holes 215 which provide clearance for the heads of the mounting bolts 109.

In the fully open position, the foot 43 of the upper panel lower edge 35 is positioned less than nine millimeters from the top edge 29 of the lower panel 3*a*', which is the industry standard for pinch resistance. This close spacing between the foot 43 and the lower panel upper edge 29 makes it difficult or impossible for a person to get his or her fingers in between the door panels 3*a*' and 3*a*". As the joint Sa moves toward its closed position, the foot 43 tends to push the person's fingers away from the joint 5*a* instead of capturing the fingers between the panels 3*a*' and 3*a*". The person's fingers are also protected from being pinched by the internal components of the hinge 1, as the hinges 1 are enclosed by the cantilever 117 and side flanges 123 of the top member 101 acting in combination with the base member side flanges 133 and hinge cover 151.

In addition to providing pinch resistence, the design of the hinges 1 helps to properly seal the joints 5*a* against wind and rain infiltration. In the closed position, the elastomeric joint seal 49 connected to the lower edge 35 of the upper panel 3*a*" contacts the upper edge 29 of the lower panel 3*a*' to seal the joint 5*a*. As the joint 5*a* opens, the seal 49 is pulled away from the upper edge 29. This pulling-away motion of the seal 49 prevents premature wear of the seal 49 which would occur if the seal were dragged across the lower panel upper edge 29. The seal 49 reseats against the lower panel upper edge 29 as the joint 5*a* moves into the closed position.

The hinge 1 works with the joint 5*b* of the insulated door 2*b* in a fashion consistent with that described above in reference to the non-insulated door 2*a*. In the open position, the gap between the outer foot 81 of the upper panel lower edge 63 and the lower panel upper edge 57 is too small for a person to get his or her fingers in. As the door 2*b* closes, the outer foot 81 tends to push the person's fingers away from the joint 5*b,* preventing them from being captured between the panels 3*b*' and 3*b*." In the closed position, the seal 87 engages the first inclined surface 67 to prevent air and water infiltration through the joint 5*b*. As the door 2*b* opens, the seal 87 lifts away from the lower panel upper edge 57 to prevent unnecessary wear of the seal 87.

It should be noted that the same hinge 1 is suitable for use on both the non-insulated door 2*a* and the insulated door 2*b*, despite the fact that the non-insulated door shown in FIG. 2 is of a greater thickness than is the insulated door of FIG. 5. The hinge 1 can be used on doors 2 of different thicknesses while still maintaining the proper spacing between the panels 3 during opening and closing by adjusting the location of the hinges 1 relative to the joints 5. The hinge 1 on the non-insulated door 2*a* in FIG. 2 is, therefore, positioned somewhat lower relative to the respective joint 5*a* than is the hinge 1 relative to the joint 5*b* of the insulated door 2*b* in FIG. 5.

Alternative Hinge

An alternative embodiment of the hinge 1 is shown in FIGS. 8–12 and generally designated by the reference numeral 200. The hinge 200 comprises a top hinge member 201', a base hinge member 203', a first or long link 205', a second or short link 207', and a cover 251.

Figure 10:
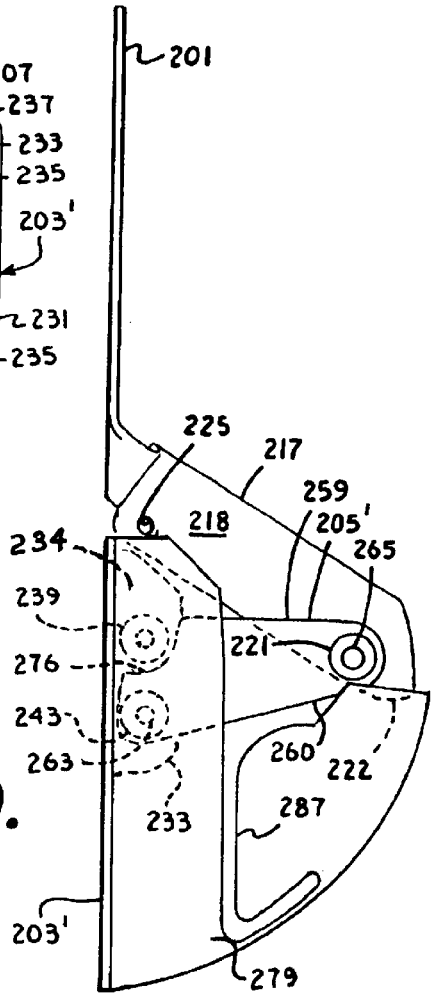
FIG. 10 is a left side view of the hinge of FIG. 8 showing the hinge in a closed position.
Figure 9:
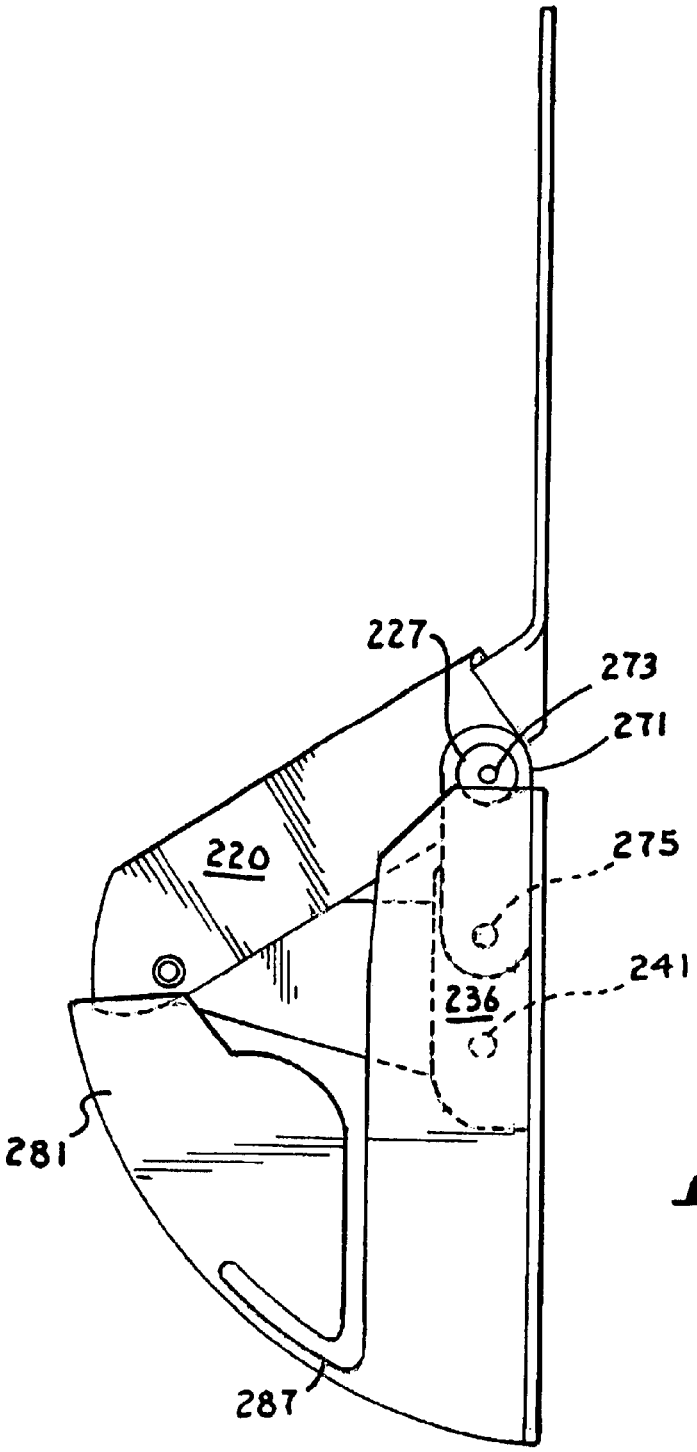
FIG. 9 is a right side view of the hinge of FIG.8 showing the hinge in a closed position.
Figure 11:
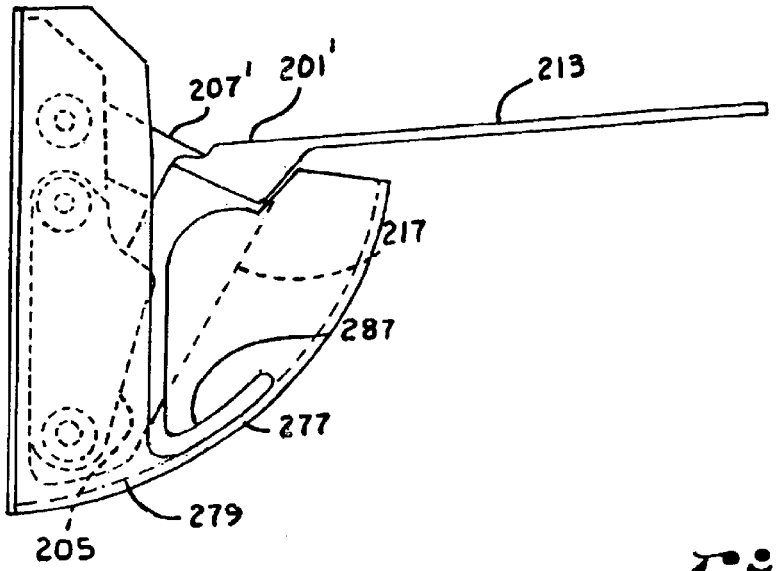
FIG. 11 is a left side view of the hinge of FIG. 8 showing the hinge in a fully open position.

The top hinge member 201' includes a mounting flange 213 which is securable to a respective upper door panel, such as upper door panel 3*a*" or 3*b*", and a cantilever 217 which extends outwardly and downwardly therefrom. The mounting flange 213 includes mounting holes 215 for receiving fasteners, such as self-tapping bolts 109, for connecting the top hinge member 201' to the upper door panel 3*a*" or 3*b*". The cantilever 217 includes a first side 218 (FIG. 10), an opposed second side 220 (FIG. 9), and a distal end 222 (FIG. 10). An outer hole or receiver 219 extends through the cantilever 217 proximate the distal end 222 and an inner hole or receiver 225 extends through the cantilever 217 inwardly from the distal end 222.

Figure 8:
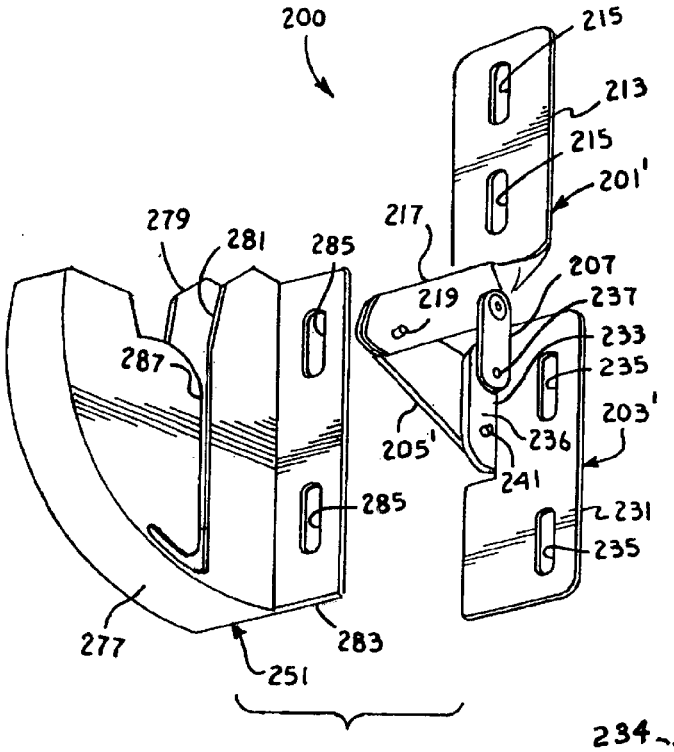
FIG. 8 is an exploded perspective view of an alternative embodiment of a hinge of the present invention.

The base hinge member 203' includes a mounting flange 231 which is securable to a respective lower door panel, such as lower door panel 3*a*' or 3*b*', and a lug 233 which extends outwardly therefrom. The mounting flange 231 includes mounting holes 235 for receiving fasteners, such as self-tapping bolts 109, for connecting the base hinge member 203' to the lower door panel 3*a*' or 3*b*'. The lug 233 includes a first side 234 (FIG. 10) and an opposed second side 236 (FIG. 8). An upper hole or receiver 237 and a lower hole or receiver 241 extend through the lug 233.

The long link 205' comprises a plate 259 which may be generally triangular in shape (for reasons to be explained below) and have a long dimension along a lower edge 260 thereof. The plate 259 has an inner receiver 263 formed therethrough proximate one end of the lower edge 260 and an outer receiver 265 formed therethrough proximate the opposite end of the lower edge 260. The short link 207' comprises an elongate plate 271 having an outer receiver 273 (FIG. 9) formed therethrough proximate one end and an inner receiver 275 formed therethrough proximate the opposite end.

The long link 205' comprises a plate 259 which may be generally triangular in shape (for reasons to be explained below) and have a long dimension along a lower edge 260 thereof. The plate 259 has an inner receiver 263 formed therethrough proximate one end of the lower edge 260 and an outer receiver 265 formed therethrough proximate the opposite end of the lower edge 260. The short link 207' comprises an elongate plate 271 having an outer receiver 273 (FIG. 9) formed therethrough proximate one end and an inner receiver 275 formed therethrough proximate the opposite end.

The links 205' and 207' are pivotally connected to the top hinge member 201' and the base hinge member 203' by pins or rivets (FIG. 8). In order to prevent interference between the links 205' and 207' and to provide additional stability to the hinge 200, the links 205' and 207' are preferably positioned such that one of the links 205 and 207 is adjacent the first sides of the cantilever 217 and the lug 233, whereas the other of the links 205' and 207' is adjacent the second sides of the cantilever 217 and the lug 233. FIGS. 8–11, for example show the long link 205' adjacent the first side 218 of the cantilever 217 and the first side 234 of the lug 233, while the short link 207' is shown adjacent the second side 220 of the cantilever 217 and the second side 236 of the lug 233. It should be understood, however, that the positions of the links 205' and 207' relative to the cantilever 217 and lug 233 could be reversed from those shown, or both links 205' and 207' could be positioned on the same side of the cantilever 217 and lug 233.

A first pin or rivet 221 (FIG.10) is received through the outer receiver 219 in the cantilever 217 of the top hinge member 201' and the outer receiver 265 in the long link 205'. A second pin or rivet 227 (FIG. 9) is received through the inner receiver 225 (FIG. 10) in the cantilever 217 of the top hinge member 201' and the outer receiver 273 (FIG. 9) in the short link 207'. A third pin or rivet 239 (FIG. 10) is received through the upper receiver 237 (FIG. 8) in the lug 233 of the base member 203' and the inner receiver 275 (FIG. 9) of the short link 207'. A fourth pin or rivet 243 (FIG. 10) is received through the lower receiver 241 (FIG. 8) in the lug 233 of the base member 203' and the inner receiver 263 (FIG. 10) in the long link 205'. The long link 205 may include a notch or recess 276 (FIG. 10) for clearing the head of the third pin 239, if necessary.

The cover 251 includes an outer guard panel 277 (FIG. 8) and a pair of opposed first and second side panels 279 and 281, respectively. The guard panel 277 generally describes an arc which is slightly larger than the arc traveled by the distal end 222 of the cantilever 217. The side panels 279 and 281 are shaped so as to enclose the space between the guard panel 277 and the mounting flange 231 of the base member 203'. The cover 251 may be connected to the base member 203' by, for example, a flange 283 which extends outwardly from side panel 281. The flange 283 includes a pair of holes 285 which receive the same bolts 109 which secure the base member 203' to the lower door panel 3*a*' or 3*b*'. The cover 251 may also be connected to the lower door panel 3*a*' or 3*b*' adjacent to the base member 203'.

The hinge 200 is moveable between a first or closed position (FIGS. 8–10) wherein the mounting flange 213 of the top member 201' is generally coplanar with the mounting flange 231 of the base member 203' and a second or fully open position (FIGS. 11 and 14) wherein the distal end 222 of the cantilever 217 is proximate the mounting flange 231 of the base member 203'. In the first position, the short link 207' may abut against the mounting flange 231 of the base member 203' to act as a limit stop. In the second position, the long link 205' may abut against the mounting flange 231 of the base member 203' to act as a limit stop.

The relative positions of the pivot pins 221, 227, 239 and 243, along with the lengths of the links 205' and 207' determine how the upper door panel 3*a*" or 3*b*" and the lower door panel 3*a*' or 3*b*' move relative to one another as the hinge 200 moves between its open and closed positions. These locations and lengths are preferably selected to provide pinch resistance by ensuring that, in the fully open position and throughout the range of motion of the hinge 200, the foot 43 (FIG. 2) of the upper panel lower edge 35 is positioned close enough too the top edge 29 of the lower panel 3*a*' (less than 9 mm) to make it difficult or impossible for a person to get his or her fingers in between the door panels 3*a*' and 3*a*". As the hinge 200 moves toward its closed position, the foot 43 tends to push the person's fingers away from the joint 5*a* instead of capturing the fingers between the panels 3*a*' and 3*a*".

It should be noted that the positions of the pivot pins 221, 227. 239 and 243, and the lengths of the links 205' and 207' can be varied to make the hinge 200 work to provide pinch resistance with doors having varied joint designs, and that, therefore, the hinge 200 is not limited to use with doors having edge profiles which are identical to those of the doors 2*a* and 2*b* described above. It should also be noted that the same is true of hinge 1; i.e., the positions of pins 21, 27, 39 and 43, along with the lengths of links 5 and 7 can be varied to fit doors with edge profiles other than those described above.

The cover 251 acts to prevent a person from inserting a finger between the distal end 222 of the cantilever 217 and the mounting flange 231 of the base member 203', and to limit access to the links 205' and 207' as much as possible. It should be noted, however, that there is some access to the links 205' and 207' above the respective side panels 279 and 281 of the cover 251. The long link 205' is accessible above the first side panel 279, however, because of the triangular shape of the link 205', the openings above and below the link 205' are too small for a person to get a fingertip into. It is therefore unlikely that a person can get pinched either between the link 205' and the cantilever 217 or between the link 205' and the first side panel 279.

The hinge 200 does, however, provide some opportunities for a person to be pinched between the cover 251 and other parts of the hinge 200. For example, a fingertip could be caught between the upper edge of one of the side panels 279 and 281 and the mounting flange 213 of the hinge top member 201' as the hinge 200 nears its second or fully open position. Similarly, a fingertip could be caught between the upper edge of the second side panel 281 and the cantilever 217 or short link 207' when the hinge 200 is moving out of its first or closed position. These undesirable aspects of the hinge 200 can be alleviated, however, by mounting the cover 251 in such a fashion that it breaks away or flexes when an interference condition occurs.

Figure 12:
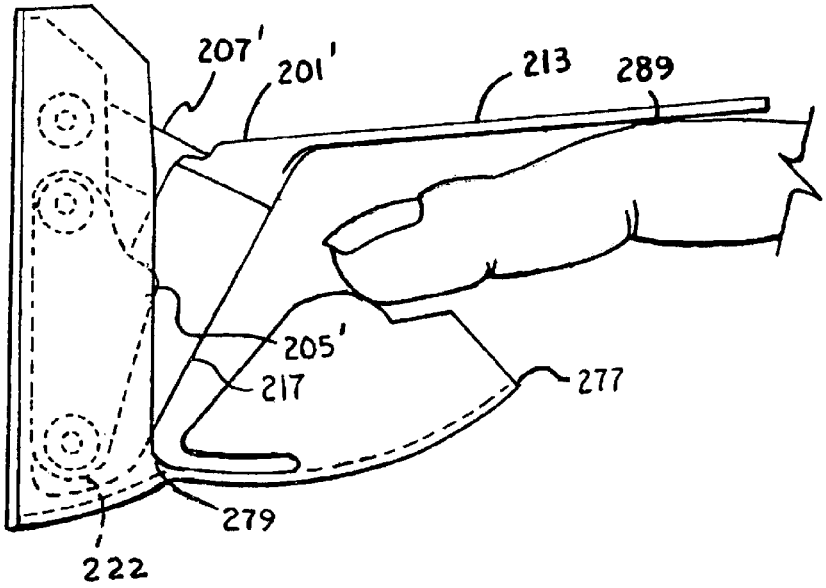
FIG. 12 is a view similar to FIG. 11 showing how the cover of the hinge flexes if an obstacle is encountered as the hinge moves in the fully open position.

The breakaway feature can be achieved by, for example, providing each of the side panels 279 and 281 of the cover 251 with a respective relief slot, such as the J-shaped relief slots 287 shown in FIGS. 8–12. The relief slots 287 each divide the respective side panel 279 or 281 into two portions. If an obstacle, such as finger 289, is interposed between the cover 251 and any moving portion of the hinge 200, the relief slots 287 allow the cover 251 to bend along the guard panel 277, as shown in FIG. 12, and thereby protect the finger 289 from injury. In hinges incorporating this type of breakaway feature, the cover 251 should be formed of a flexible material such as plastic or relatively thin sheet metal. The breakaway feature could also be obtained by providing a line of weakness or releasable connection (not shown) between the flange 283 and the second side panel 281 of the cover 251.

It is to be understood that while certain forms of the present invention have been illustrated and described herein, it is not to be limited to the specific forms or arrangement of parts described and shown.

What is claimed is:

1. A pinch resistant hinge for an upward acting sectional door, comprising:

a) a first hinge member having a first member mounting flange and a cantilever extending outwardly therefrom, said cantilever including a distal end;

b) a second hinge member having a second member mounting flange;

c) a first link pivotally connected to said cantilever proximate said distal end thereof and pivotally connected to said second hinge member;

d) a second link pivotally connected to said cantilever inwardly from said distal end thereof and pivotally connected to said second member; wherein e) said hinge is moveable through a range of motion between a first position wherein said first member mounting flange is generally coplanar with said second member mounting flange and a second position; and wherein f) said second link abuts against said second member mounting flange when said hinge is in said first position.

2. The hinge as in claim 1 wherein said cantilever distal end is positioned proximate said second member mounting flange when said hinge is in said second position.

3. The hinge as in claim 2 and further including a cover connected to said second hinge member, said cover being adapted to prevent the insertion of a human fingertip between said cantilever distal end and said second member mounting flange as said hinge moves from said first position toward said second position.

4. The hinge as in claim 1 wherein said first link abuts against said second member mounting flange when said hinge is In said second position.

5. The hinge as in claim 4 and further including a cover connected to said second hinge member, said cover being adapted to prevent the insertion of a human fingertip between said first link and said second member mounting flange as said hinge moves from said first position toward said second position.

6. The hinge as in claim 1 wherein said first link is shaped to prevent the insertion of a human fingertip between said first link and said cantilever throughout the range of motion of said hinge.

7. The hinge as in claim 6 wherein said first link is generally triangular in shape.

8. A pinch resistant hinge in combination with an upward acting sectional door having a plurality of door panels in abutting relation with one another along respective horizontal joints, each said door panel having an interior plane and an exterior plane, each said joint being formed between an upper edge of a lower one of said door panels and a lower edge of an upper one of said door panels, said lower edge of said upper door panel including an elongated foot extending downwardly therefrom proximate an outer surface of said upper door panel, said hinge comprising:

a) a first hinge member having a first member mounting flange securable to the upper door panel and a cantilever extending outwardly from said first member mounting flange, said cantilever including a distal end;

b) a second hinge member having a second member mounting flange securable to the lower door panel;

c) a first link pivotally connected to said cantilever at a first pivot point proximate said distal end thereof and pivotally connected to said second hinge member at a second pivot point;

d) a second link pivotally connected to said cantilever at a third pivot point inward from said distal end thereof and pivotally connected to said second member at a fourth pivot point; wherein e) said hinge has a range of motion between a first position and a second position;

f) the locations of said pivot points and the lengths of said first and second links are selected to keep the foot on the lower edge of the upper door panel within a predetermined distance from the upper edge of the lower door panel throughout the range of motion of the hinge when said mounting flanges are secured to the respective door panels; and wherein g) each of said pivot points is located outside of a space defined by the interior plane and the exterior plane of the respective door panel.

9. A pinch resistant hinge for an upward acting sectional door having a plurality of door panels in abutting relation with one another along respective horizontal joints, each said door panel having an interior plane and an exterior plane, each said joint being formed between an upper edge of a lower one of said door panels and a lower edge of an upper one of said door panels, said lower edge of said upper door panel including an elongated foot extending downwardly therefrom proximate an outer surface of said upper door panel, said hinge comprising:

a) a first hinge member having a first member mounting flange securable to the upper door panel and a cantilever extending outwardly from said first member mounting flange, said cantilever including a distal end;

b) a second hinge member having a second member mounting flange securable to the lower door panel;

c) a first link pivotally connected to said cantilever at a first pivot point proximate said distal end thereof and pivotally connected to said second hinge member at a second pivot point;

d) a second link pivotally connected to said cantilever at a third pivot point inward from said distal end thereof and pivotally connected to said second member at a fourth pivot point; wherein;

e) said hinge has a range of motion between a first position and a second position;

f) the locations of said pivot points and the lengths of said first and second links are selected to keep the foot on the lower edge of the upper door panel within a predetermined distance from the upper edge of the lower door panel throughout the range of motion of the hinge when said mounting flanges are secured to the respective door panels;

g) a cover connectable to one of said second hinge member and the lower door panel, said cover being adapted to prevent the insertion of a human finger between said cantilever distal end and said second hinge member throughout the range of motion of the hinge; and h) wherein said cover includes a guard panel and a pair of side panels.

10. The hinge as in claim 9 wherein each said side panel includes a respective relief slot, said relief slots allowing said cover to flex along said guard panel if an obstacle is interposed between said cover and a moving portion of said hinge as said hinge moves from said first position toward said second position.

11. The hinge as in claim 9 wherein said cover includes a guard panel and a pair of side panels.

12. The hinge as in claim 11 wherein each said side panel includes a respective relief slot, said relief slots allowing said cover to flex along said guard panel if an obstacle is interposed between said cover and a moving portion of said hinge as said hinge moves from said first position toward said second position.

13. An upward acting sectional door moveable between open and closed positions, comprising:

a) a plurality of door panels in abutting relation with one another along respective horizontal joints, each said joint formed between an upper edge of a lower one of said door panels and a lower edge of an upper one of said door panels, said upper door panel being pivotally connected to said lower door panel by a hinge, said lower edge of said upper door panel including an elongated foot extending downwardly therefrom proximate an outer surface of said upper door panel; wherein b) said hinge comprises:

i) a first hinge member having a first member mounting flange secured to the upper door panel and a cantilever extending outwardly from said first member mounting flange, said cantilever including a distal end;

ii) a second hinge member having a second member mounting flange secured to the lower door panel;

iii) a first link pivotally connected to said cantilever at a first pivot point proximate said distal end thereof and pivotally connected to said second hinge member at a second pivot point;

iv) a second link pivotally connected to said cantilever at a third pivot point inward from said distal end thereof and pivotally connected to said second member at a fourth pivot point;

c) said hinge has a range of motion between a first position and a second position; and d) the locations of said pivot points and the lengths of said first and second links are selected to keep said foot within a predetermined distance from said upper edge of said lower door panel throughout the range of motion of said hinge.

14. The door as in claim 13 wherein said predetermined distance is selected to prevent a human fingertip from being inserted between said foot and said upper edge of said lower door panel.

15. The door as in claim 13 wherein said predetermined distance is less than or equal to nine millimeters.

16. The door as in claim 13 wherein each said door panel has an interior plane and an exterior plane and each of said pivot points is located outside a space defined by the interior plane and exterior plane of the respective door panel.

17. The door as in claim 13 and further including a cover connected to one of said second hinge member and said lower door panel, said cover being adapted to prevent the insertion of a human finger between said cantilever distal end and said second member throughout the range of motion of the hinge.

18. The door as in claim 17 wherein said cover includes a guard panel and a pair of side panels.

19. The door as in claim 18 wherein each said side panel includes a respective relief slot, said relief slots allowing said cover to flex along said guard panel if an obstacle is interposed between said cover and a moving portion of said hinge as said hinge moves from said first position toward said second position.

20. The door as in claim 13 and further including a cover connected to one of said second hinge member and said lower door panel, said cover being adapted to prevent the insertion of a human finger between said cantilever distal end and said lower door panel throughout the range of motion of the hinge.

21. The door as in claim 20 wherein said cover includes a guard panel and a pair of side panels.

22. The door as in claim 21 wherein each said side panel includes a respective relief slot, said relief slots allowing said cover to flex along said guard panel if an obstacle is interposed between said cover and a moving portion of said hinge as said hinge moves from said first position toward said second position.

23. A pinch resistant hinge for an upward acting sectional door, comprising:

a) a first hinge member having a first member mounting flange and a cantilever extending outwardly therefrom, said cantilever including a distal end;

b) a second hinge member having a second member mounting flange;

c) a first link pivotally connected to said cantilever proximate said distal end thereof at a first pivot joint and pivotally connected to said second hinge member at a second pivot joint;

d) a second link pivotally connected to said cantilever inwardly from said distal end thereof at a third pivot joint, and pivotally connected to said second member at a fourth pivot joint;

e) said hinge being moveable through a range of motion between a first position wherein said first member mounting flange is generally coplanar with said second member mounting flange and a second position;

f) said pivot points and lengths of said first and second links are selected to cause said first hinge member to move through a selected range of motion with respect to said second hinge member between said first position and said second position; and g) wherein said second link abuts against said second member mounting flange when said hinge is in said first position.

24. The hinge as in claim 23 and further including a cover connected to said second hinge member, said cover being adapted to prevent the insertion of a human fingertip between said cantilever distal end and said second member mounting flange as said hinge moves from said first position toward said second position.

25. The hinge as in claim 23 wherein said first link abuts against said second member mounting flange when said hinge is in said second position.

26. The hinge as in claim 25 and further including a cover connected to said second hinge member, said cover being adapted to prevent the insertion of a human fingertip between said first link and said second member mounting flange as said hinge moves from said first position toward said second position.

27. The hinge as in claim 23 wherein said first link is generally triangular in shape.

28. A pinch resistant hinge in combination with an upward acting sectional door having a plurality of door panels in abutting relation with one another along respective horizontal joints, each said door panel having an interior plane and an exterior plane, each said joint being formed between an upper edge of a lower one of said door panels and a lower edge of an upper one of said door panels, said lower edge of said upper door panel including an elongated foot extending downwardly therefrom proximate an outer surface of said upper door panel, said hinge comprising:

a) a first hinge member having a first member mounting flange securable to the upper door panel and a cantilever extending outwardly from said first member mounting flange, said cantilever including a distal end;

b) a second hinge member having a second member mounting flange securable to the lower door panel;

c) a first link pivotally connected to said cantilever at a first pivot point proximate said distal end thereof and pivotally connected to said second hinge member at a second pivot point;

d) a second link pivotally connected to said cantilever at a third pivot point inward from said distal end thereof and pivotally connected to said second member at a fourth pivot point; wherein e) said hinge has a range of motion between a first position and a second position;

f) the locations of said pivot points and the lengths of said first and second links are selected to keep the foot on the lower edge of the upper door panel within a predetermined distance from the upper edge of the lower door panel throughout the range of motion of the hinge when said mounting flanges are secured to the respective door panels;

g) a cover connectable to one of said second hinge member and the lower door panel, said cover being adapted to prevent the insertion of a human finger between said cantilever distal end and said second hinge member throughout the range of motion of the hinge; and h) wherein said cover includes a guard panel and a pair of side panels.

29. The hinge as in claim 28 wherein each said side panel includes a respective relief slot, said relief slots allowing said cover to flex along said guard panel if an obstacle is interposed between said cover and a moving portion of said hinge as said hinge moves from said first position toward said second position.

30. The hinge as in claim 28 and further including cover connected to one of said second hinge member and the lower door panel, said cover being adapted to prevent the insertion of a human finger between said cantilever distal end and the lower door panel throughout the range of motion of the hinge, said cover includes a guard panel and a pair of side panels.

31. The hinge as in claim 30 wherein each said side panel includes a respective relief slot, said relief slots allowing said cover to flex along said guard panel if an obstacle is interposed between said cover and a moving portion of said hinge as said hinge moves from said first position toward said second position.

32. An upward acting sectional door moveable between open and closed positions, comprising:

a.) a plurality of door panels in abutting relation with one another along respective horizontal joints, each said door panel having an inner surface and an outer surface; and b.) a hinge pivotally connecting a lower one of said door panels to an adjacent upper one of said panels, the hinge comprising:

i) a top member fastened to said inner surface of said upper door panel and extending substantially outward therefrom;

ii) a base member fastened to said inner surface of said lower door panel and extending substantially outward therefrom; and iii) first and second links; each of said links having a first end pivotally connected to said top member and a second end pivotally secured to said base member; wherein said first and second links are of different lengths.

33. An upward acting sectional door moveable between open and closed positions, comprising:

a) a plurality of door panels in abutting relation with one another along respective horizontal joints, each said door panel having an inner surface and an outer surface; and b) a hinge pivotally connecting a lower one of said door panels to an adjacent upper one of said panels, the hinge comprising:

i) a top member fastened to said inner surface of said upper door panel and extending substantially outward therefrom;

ii) a base member fastened to said inner surface of said lower door panel and extending substantially outward therefrom; and iii) first and second links; each of said links having a first end pivotally connected to said top member and a second end pivotally secured to said base member; wherein said first and second links are non-parallel with one another.

34. An upward acting sectional door moveable between open and closed positions, comprising:

a) a plurality of door panels in abutting relation with one another along respective horizontal joints, each said door panel having an inner surface and an outer surface; and b) a hinge pivotally connecting a lower one of said door panels to an adjacent upper one of said panels, the hinge comprising:

i) a top member fastened to said inner surface of said upper door panel and extending substantially outward therefrom;

ii) a base member fastened to said inner surface of said lower door panel and extending substantially outward therefrom; and iii) first and second links: each of said links having a first end pivotally connected to said top member and a second end pivotally secured to said base member; wherein pivot axes of said first and second links are non-collinear.

35. An upward acting sectional door moveable between open and closed positions, comprising:

a) a plurality of door panels in abutting relation with one another along respective horizontal joints, each said door panel having an inner surface and an outer surface; and b) a hinge pivotally connecting a lower one of said door panels to an adjacent upper one of said panels, the hinge comprising:

i) a top member fastened to said inner surface of said upper door panel and extending substantially outward therefrom;

ii) a base member fastened to said inner surface of said lower door panel and extending substantially outward therefrom; and iii) first and second links; each of said links having a first end pivotally connected to said top member and a second end pivotally secured to said base member; wherein said first and second links are spaced from the horizontal joint between the adjacent panels.

36. An upward acting sectional door moveable between open and closed positions, comprising:

a) a plurality of door panels in abutting relation with one another along respective horizontal joints, each said door panel having an inner surface and an outer surface; and b) a hinge pivotally connecting a lower one of said door panels to an adjacent upper one of said panels, the hinge comprising:

i) a top member fastened to said inner surface of said upper door panel and extending substantially outward therefrom;

ii) a base member fastened to said inner surface of said lower door panel and extending substantially outward therefrom; and iii) first and second links; each of said links having a first end pivotally connected to said top member and a second end pivotally secured to said base member; wherein said first and second links are positioned rearwardly of the back face of the door panels when the door is in a closed position.

* * * * *